US007178701B2

(12) United States Patent
Crosnier et al.

(10) Patent No.: US 7,178,701 B2
(45) Date of Patent: Feb. 20, 2007

(54) METERING PUMP

(76) Inventors: Daniel Crosnier, 14, rue Jacques-Lanty, F-76550 Offranville (FR); Jean-Marie Dulery, 52, Avenue Pterre Sémard, F-94210 La Varenne Saint Hilaire (FR)

( * ) Notice: Subject to any disclaimer, the term of this patent is extended or adjusted under 35 U.S.C. 154(b) by 445 days.

(21) Appl. No.: 10/477,443

(22) PCT Filed: May 7, 2002

(86) PCT No.: PCT/FR02/01564

§ 371 (c)(1),
(2), (4) Date: May 13, 2004

(87) PCT Pub. No.: WO02/089996

PCT Pub. Date: Nov. 14, 2002

(65) Prior Publication Data

US 2005/0023298 A1 Feb. 3, 2005

(30) Foreign Application Priority Data

May 10, 2001 (FR) ..... 01 06175

(51) Int. Cl.
*B65D 88/054* (2006.01)

(52) U.S. Cl. ..... 222/321.9; 222/341

(58) Field of Classification Search ..... 222/321.1, 222/321.2, 321.6–321.9, 340, 341
See application file for complete search history.

(56) References Cited

U.S. PATENT DOCUMENTS 3,753,518 A * 8/1973 Kutik ..... 222/383.1
4,911,336 A * 3/1990 Blake ..... 222/321.7
5,267,673 A * 12/1993 Crosnier et al. ..... 222/321.7

FOREIGN PATENT DOCUMENTS

EP 0 726 097 A1 8/1996
FR 1 441 127 A 12/1966

* cited by examiner

*Primary Examiner*—Kevin Shaver
*Assistant Examiner*—Melvin A. Cartagena
(74) *Attorney, Agent, or Firm*—Baker & Daniels LLP

(57) ABSTRACT

The invention relates to a metering pump comprising a pump barrel (1) housing a dose chamber (32) and control means that can be moved between a discharge position and a rest position. The inventive metering pump is characterised in that the control means comprise: a push rod (2); a piston (3) that can slide in relation to the push rod (2) and in relation to the pump barrel (1) all the while remaining in permanent contact with said two elements; and an elastically-deformable annular valve (4) that rests permanently against the push rod (2). The control means are moved between the rest position and the discharge position in two steps; the push rod (2) slides in relation to the piston (3) in the pump barrel; and subsequently the push rod (2) and the piston (3) slide jointly in the pump barrel (1) and discharge opening (42) is released.

8 Claims, 3 Drawing Sheets

METERING PUMP

Figure 1:
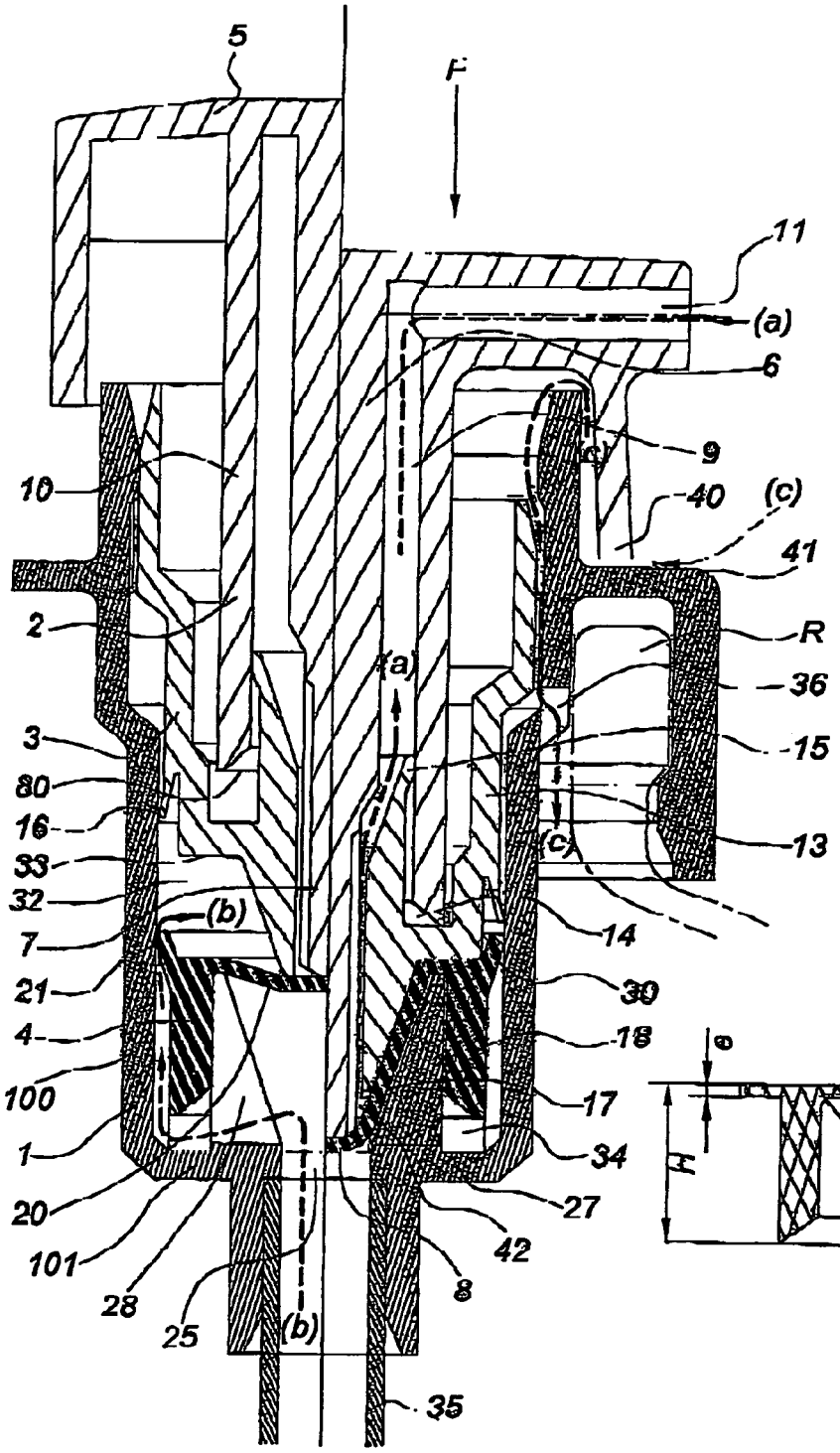

The present invention relates to a metering pump, designed to be mounted by means of a screw, snap-fit, welded connection, etc., on various rigid or flexible receptacles such as bottles, tubes or pots, in particular receptacles containing cosmetic or pharmaceutical products or alternatively food products of different viscosities which may range from liquid products to products with a creamy consistency.

Different types of metering pumps have been on the market for a number of years, all of which require the use of a certain number of parts such as springs, bearings, valves, stoppers and others. Apart from the labour-intensive effort involved in manufacturing and assembling these parts, these metering pumps generally have the disadvantage of failing to provide an adequate seal and allowing outside air to be drawn into the interior as they opened and closed, which means that preservatives have to be added to the contents in order to prevent oxidation.

In order to remedy these disadvantages, metering pumps have already been proposed, particularly in patent specification EP-0 726 097, which comprise a pump body made from a rigid or semi-rigid material which can be adapted to fit a receptacle, and enclosing a metering chamber, as well as elastically deformable control means which can be operated from the exterior so as to be displaced in succession between a dispensing position and a non-operating position to enable a dose of the product to be ejected from the metering chamber to the exterior via an ejection orifice and then transfer a new dose of the product from the receptacle to the metering chamber and so on.

As a rule, the pump body used with such metering pumps is generally bounded at its internal top part by an annular side wall and by a front-end face incorporating a filling orifice which communicates with the interior of the receptacle.

With this prior art design, the control means are automatically returned from the dispensing position to the non-operating position when not subjected to any external constraint with a view to creating a vacuum pressure to enable a dose of product to be sucked towards the metering chamber.

In spite of their undeniable specific properties, the disadvantage of such metering pumps is that they are often relatively complex and have a tendency to become ineffectual after they have been used for the first few times.

Furthermore, it is not always easy to meter highly viscous products and the elastically deformable control means sometimes encounter problems in resuming their initial shape once transferred from the dispensing position back to the non-operating position, which can lead to a certain amount of outside air being induced.

The objective of the present invention is to overcome these drawbacks by proposing a simple, efficient and reliable metering pump which will enable not only liquids products, but equally products with a relatively high viscosity, to be metered and will do so whilst dispensing doses of a large volume.

To this end, the invention relates to a metering pump of the type outlined above, characterised in that the control means are provided in the form of a push button of a rigid or semi-rigid material, a plunger made from a flexible thermoplastic material designed to slide relative to the push button and relative to the pump body whilst remaining in permanent contact with these two elements, as well as an annular valve made from an elastically deformable material which is constantly supported against the push button.

As a result of one essential feature of the invention, the control means are displaced between the non-operating position and the dispensing position in two stages, namely a first stage on the one hand, during which the push button slides inside the pump body relative to the plunger and the metering chamber is isolated from the ejection orifice, and a second stage on the other hand, during which the push button and the plunger slide as a unit inside the pump body, and a dispensing orifice communicates with the metering chambers, thereby uncovering the ejection orifice.

The fact that there is a delay before the dispensing orifice is uncovered is a very advantageous feature of the invention since it largely facilitates priming of the metering pump when used for the first few times.

As a result of another feature of the invention, the push button has a support face and a median rod which is constantly supported against the annular valve and is surrounded by an annular ejection passage which is bounded by a tubular wall and communicates with the ejection orifice.

The plunger in turn has a tubular end-piece mounted around the median rod of the push button on a level with the free end thereof, and its external periphery is extended by a peripheral fin so as to define a surface which acts as a stop for the free end of the tubular wall of the push button as it is being displaced between the non-operating position and the dispensing position during the second stage.

This plunger is in permanent contact with the push button by means of a first sealing lip constantly supported against the external face of the annular ejection passage on the one hand, and with the pump body by means of a second sealing lip constantly supported against the annular side wall thereof, on the other.

As a result of another feature of the invention, the annular valve is disposed between the front-end face of the pump body and the free end of the median rod of the push button.

This annular valve has an essentially circular, stretchable closing membrane which is constantly supported against the free end of the median rod of the push button by its median part and is designed so that its periphery moves into abutment with the annular side wall of the pump body in order to close off the filling orifice.

The closing membrane co operates with the annular side wall of the pump body and with a closing wall of the plunger, which is contiguous with the second scaling lip and defines the metering chamber.

As proposed by the invention, the tubular end-piece of the plunger is in abutment with the closing membrane of the annular valve in the non-operating position and during the first stage of displacement between the non-operating position and the dispensing position so that it closes off the metering chamber, but moves back during the second stage of this displacement so as to uncover the dispensing orifice and allow the product contained in the metering chamber to pass between this end-piece and the median rod of the push button so that it can be evacuated via the ejection passage and through the ejection orifice.

By virtue of another feature of the invention, the median rod of the push button may be provided with at least one longitudinal groove on a level with its free end and is preferably provided with a series of longitudinal grooves uniformly distributed around its periphery.

The purpose of these grooves is to allow the product contained in the metering chamber to pass between the tubular end-piece of the plunger and the median rod of the push button so that it can be ejected to the exterior.

As a result of one particularly advantageous feature of the invention, the annular valve is a cylindrical ring, one of the front-end faces of which is closed by the closing membrane.

As proposed by the invention, this membrane projects onto the periphery of the cylindrical ring so as to define a flange, which is supported against the annular side wall of the pump body in order to isolate the metering chamber from the internal part of the receptacle as the metering pump is displaced from the non-operating position into the dispensing position.

As the metering pump is moved towards the non-operating position, this flange moves back away from the annular side wall of the pump body to enable the metering chamber to fill.

As the metering pump is then displaced from the non-operating position into the dispensing position, the elastic deformation of the closing membrane of the annular valve then creates a joint, which hermetically seals the metering chamber from the internal part of the receptacle, whilst creating a spring effect to enable the push-rod to be returned automatically to its non-operating position.

Isolating the metering chamber in this way enables the product contained in it to be evacuated towards the exterior under the action of its consecutive compression as the closing wall of the plunger moves closer along with the closing membrane of the annular valve, which makes contact at the end of the dispensing process.

In accordance with one feature of the invention, the front-end face of the pump body has receiving elements for the annular valve.

These receiving elements may advantageously be provided in the form of a tubular sleeve surrounding the filling orifice and have radial slots in a quoin-type arrangement to enable the product contained in the receptacle to pass towards the metering chamber as the metering pump is returned from the dispensing position to the non-operating position.

For the purposes of the invention, the conical inner face of this tubular sleeve acts as a seat for the closing membrane, whilst its cylindrical outer face co-operates with the pump body to define a mounting seat for the cylindrical ring of the annular valve.

In accordance with another feature of the invention, the side wall of the pump body is provided with an obliquely inclined shoulder, which forms a seat for the flange of the annular valve and extends alongside the mounting seat of the cylindrical ring, incorporating a series of slots defining passages which allow the product contained in the receptacle to be transferred towards the metering chamber as the metering pump is being returned from the dispensing position towards the non operating position.

Figure 2:
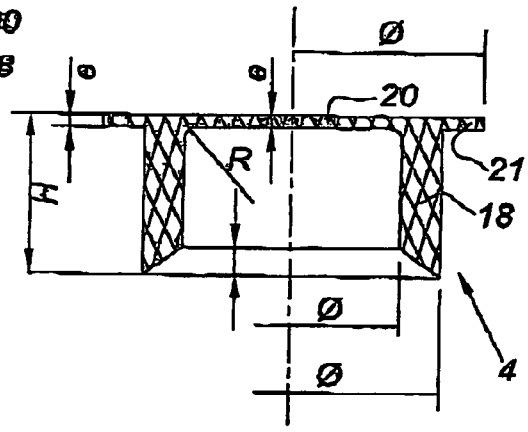
Figure 4:
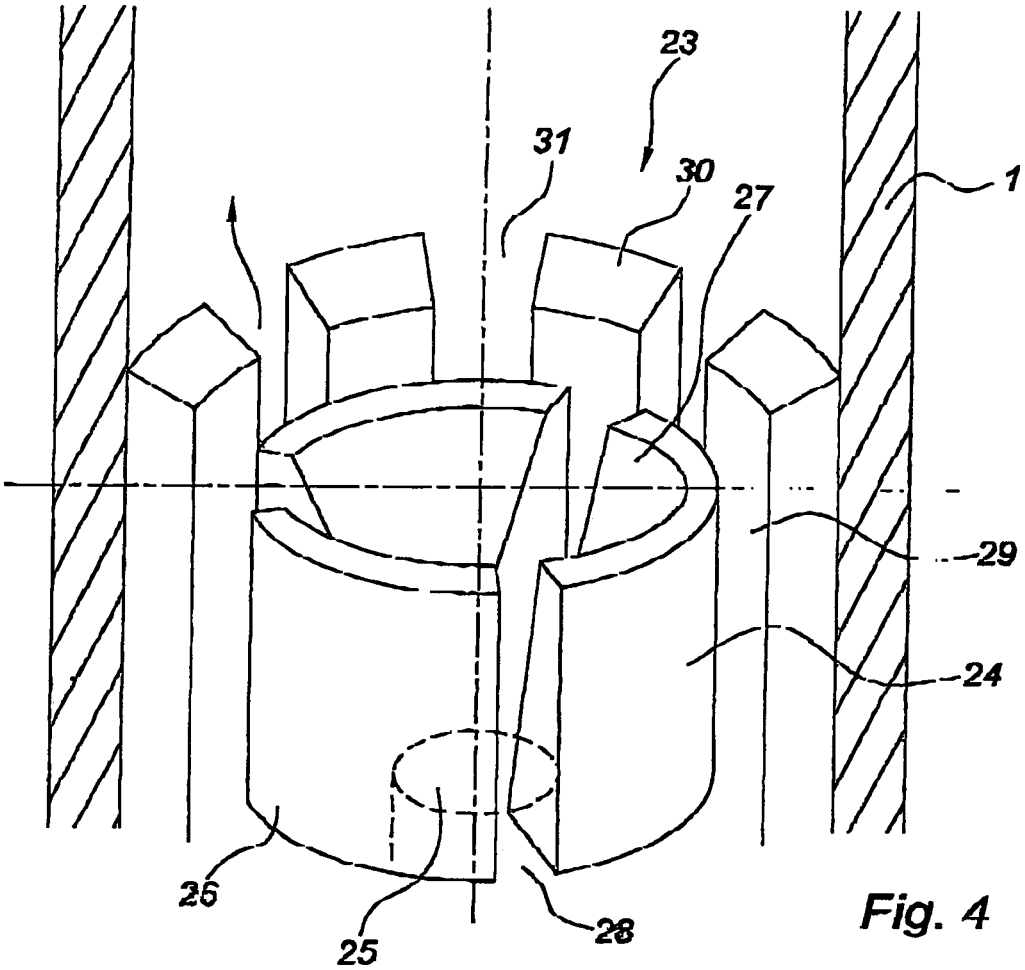
Figure 3:
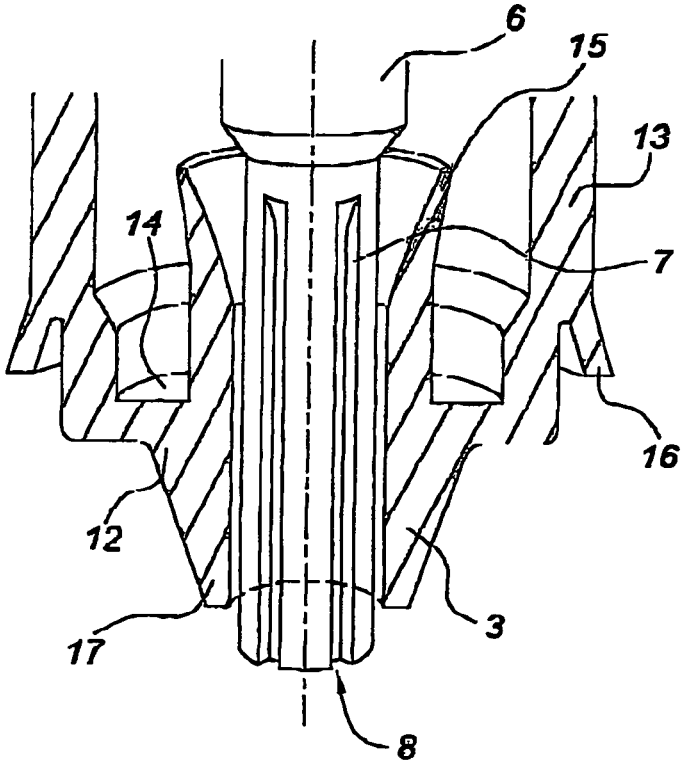
Figure 5C:
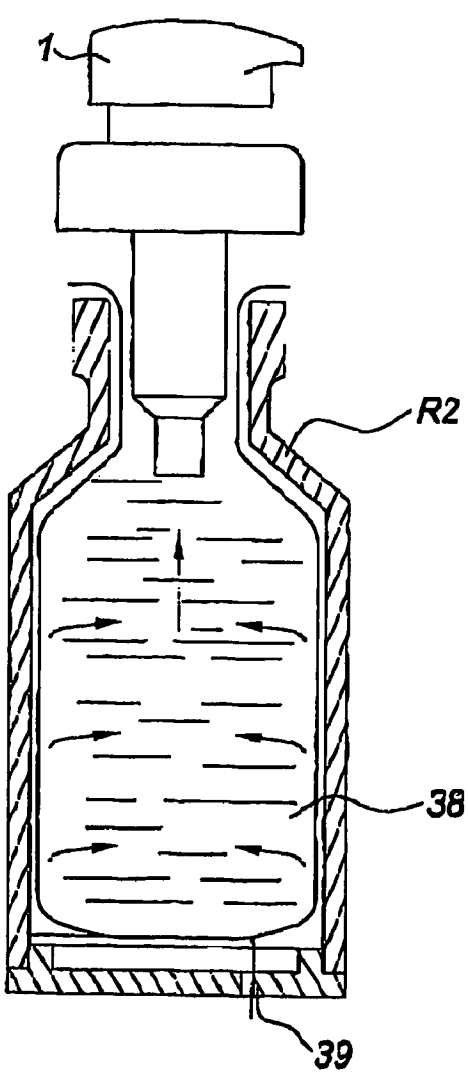
Figure 5B:
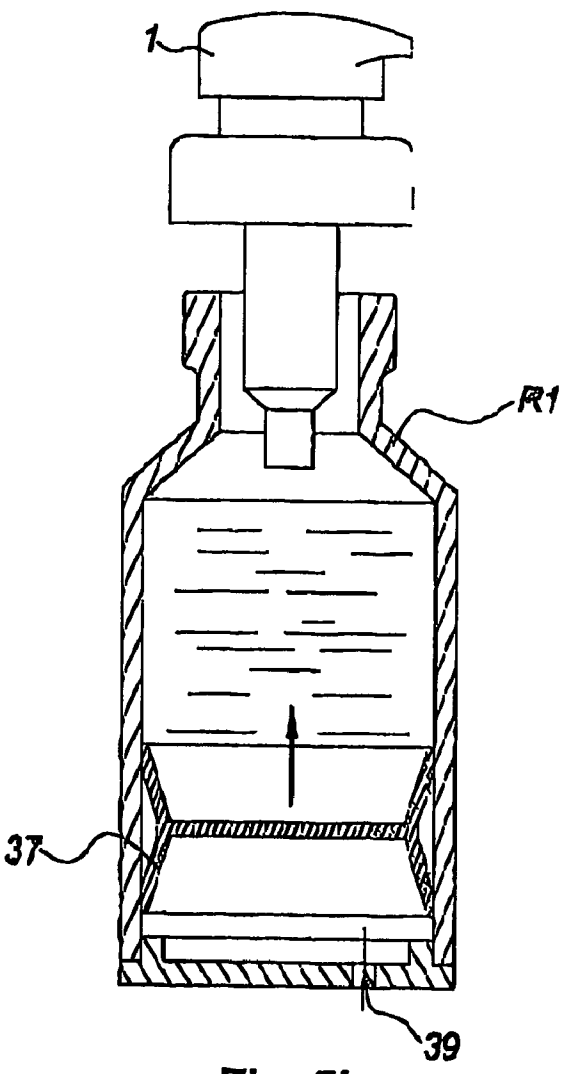
Figure 5A:
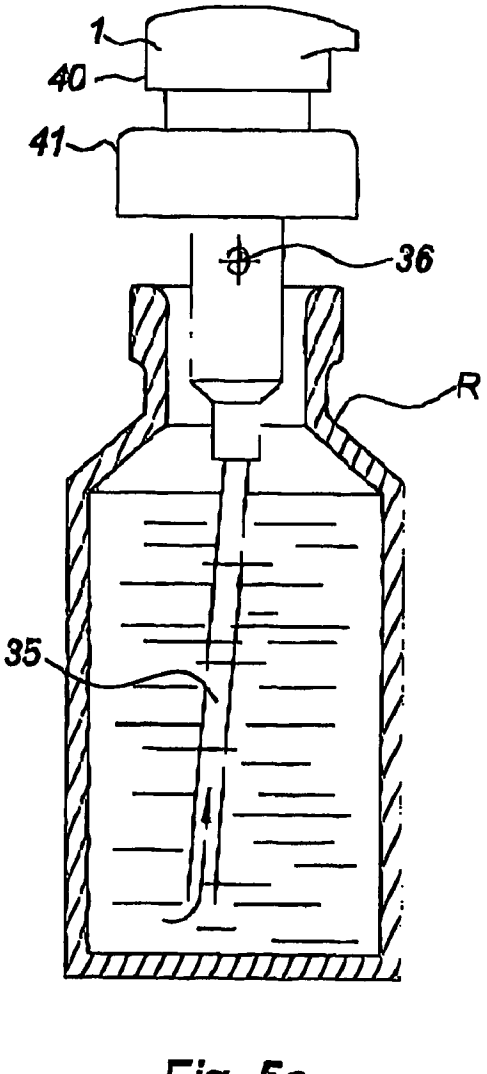

The features of the metering pump will be described in more detail with reference to the appended drawings, in which:

FIG. 1 is a view of the metering pump in section, illustrating the non-operating position on the left-hand side and the dispensing position on the right-hand side, FIG. 2 is a view in section showing the annular valve in the non-operating position, FIG. 3 is a view in partial section showing the tubular end-piece of the plunger mounted around the median rod of the push-rod, FIG. 4 is a schematic perspective view of the receiving elements for the annular valve, FIGS. 5*a*, 5*b* and 5*c* are schematic sections illustrating the metering pump mounted on different receptacles.

FIG. 1 illustrates the metering pump, which essentially consists of a pump body 1 illustrated in FIGS. 5*a*, 5*b* and 5*c*, which is mounted on a receptacle R.

At its internal part, this pump body 1 has an annular side wall 100 of a substantially cylindrical shape and a front-end face 101 with a filling orifice 25 pierced through it, which communicates with the interior of the receptacle R.

This pump body 1 houses a push button 2, a plunger 3 and an elastically deformable annular valve 4.

The push button 2 has a support face 5 on which the user can exert a pressure in the direction of arrow F, as well as a median rod 6, the periphery of which is provided with longitudinal grooves 7 on a level with its free end 8.

These grooves 7 are illustrated in more detail in FIG. 3.

In FIG. 1, the median rod 6 of the push button 2 is surrounded by an ejection passage 9, which is bounded by a tubular wall 10.

The ejection passage 9 communicates with an orifice 11 which enables the product contained in the receptacle R to be ejected in a manner that will be explained in more detail farther on in this description.

The plunger 3, which is inserted between the pump body 1 and the push button 2, has a tubular end piece 12, which is mounted around the median rod 6 of the push button 2 close to the free end 8 thereof and is extended at its external periphery by a peripheral fin 13 so as to define a surface acting as a stop 14 for the free end 80 of the tubular wall 10 of the push button 2.

As illustrated in FIG. 1, the push button 2 is able to slide in the internal part of the pump body 1 between a non operating position illustrated on the left-hand side of the drawing and a dispensing position illustrated at the right-hand side.

The plunger 3 is also able to slide along the pump body 1 and also along the push button 2 and is in permanent contact with these two elements 1 and 2, on the one hand by means of a first annular sealing lip 15 constantly supported against the external face of the ejection passage 9 of the push button 2 and, on the other, by a second sealing lip 16 constantly supported against the annular side wall 100 of the pump body 1.

The two annular sealing lips 15 and 16 are illustrated in FIG. 3.

As illustrated in FIGS. 1 and 2, the annular valve 4 is inserted between the push button 2 and the plunger 3 on the one hand, and between the front-end face 101 of the pump body 1 on the other, and is provided in the form of a cylindrical ring 18, one of the front-end faces of which is closed by a closing membrane 20, which is circular in shape.

This membrane 20 projects out from the periphery of the cylindrical ring 18 to define a flange 21 which is supported against the annular side wall 100 of the pump body 1.

As illustrated in FIG. 1, the median part of the closing membrane 20 of the annular valve 4 is constantly supported against the end 8 of the median rod 6 of the push button 2 and may be elastically deformed by the latter, as illustrated in the right-hand part of this drawing.

As illustrated in FIG. 1, the side wall 100 of the pump body 1, the closing membrane 20 of the valve 4 as well as a closing wall 33 of the plunger 3 located between the second sealing lip 16 and the end 17 of the tubular end-piece 12 co-operate to bound a metering chamber 32, the purpose of which will be explained in more detail farther on this description.

The metering chamber is permanently hermetically sealed by the second sealing lip 16 and may be isolated from the outside and the internal part of the receptacle R, on the one hand by the free end 17 of the tubular end-piece 12 of the plunger 3 in abutment with the closing membrane 20 of the valve 4, and on the other by the flange 21 abutting with the side wall 100 of the pump body 1.

As illustrated in FIG. 1, the front-end face 101 of the pump body 1 is provided with receiving elements 23 for the annular valve 4.

As illustrated in FIGS. 1 and 4, these receiving elements 23 comprise a tubular sleeve 24 surrounding the filling orifice 23 enabling the pump body 1 to communicate with the internal part of the receptacle R.

This tubular sleeve 24 has an outer face 26 which is cylindrical in shape and an inner race 27 which is conical in shape and inclined towards the filling orifice 25 and has radial slots 28 forming a quoin-type arrangement.

The conical inner face 27 of the tubular sleeve 24 acts a seat for the closing membrane 20 of the annular valve 4.

The cylindrical outer face 26 of the tubular sleeve 21 co-operates with the pump body 1 so as to define a mounting seat 29 for the cylindrical ring 18 of the annular valve 4.

As illustrated in FIGS. 1 and 4, the side wall 100 of the pump body 1 is provided with an obliquely inclined shoulder 30, which acts as a seat for the flange 21 of the annular valve 4.

Alongside the mounting seat 29, this shoulder 30 extends towards the front-end face 101 of the pump body 1 incorporating a series of longitudinal slots 31 defining side passages for the product enclosed in the receptacle R through to the metering chamber 32.

As illustrated in FIG. 1, the longitudinal slots 31 are extended by transverse slots 34 provided on the front-end face 22 of the pump body 1, the purpose of which will be explained later on in this description.

As illustrated in FIGS. 1 and 5*a*, the receptacle R is made from glass, in particular by blowing, or is made by extrusion, blowing or injection-blowing from a thermoplastic material.

As illustrated in these drawings, the pump body 1 is provided with an immersed tube 35 extending as far as the base of the receptacle R to enable the product contained in it to be sucked up.

In this configuration, the body 1 is also provided with an orifice 36, which enables compensating air to be drawn through from the outside towards the interior of the receptacle R.

The receptacle $R_1$ illustrated in FIG. 5*b* is combined with a plunger 37, mounted on the base thereof and designed to be displaced upwards as indicated by the arrow so that it slides inside the receptacle $R_1$ in proportion to the metered amount of product ejected to the exterior.

The receptacle $R_2$ illustrated in FIG. 5*c* is provided with a shrinkable bag 38 in its interior, which shrinks in proportion to the metered amount of product ejected to the exterior as indicated by the arrows shown in this drawing.

The shrinkable bag 38 may be fixed either to the receptacle $R_2$ or to the pump body 1.

As illustrated in FIGS. 5*b* and 5*c*, the receptacles $R_1$ and $R_2$ are provided with the orifice 39 in contact with the atmosphere at their bottom part but there is no need to provide an intake for external air like the air intake 36 (FIG. 5*a*) on the pump body 1.

The metering pump illustrated in FIG. 1 operates as explained below.

In the non-operating position illustrated in the left-hand part of FIG. 1, the push button 2 is offset at its maximum in the upward direction and the bottom end 80 of the tubular wall 10 is no longer supported against the surface acting as a stop 14 for the plunger 3 but is situated at a distance there from.

In this position, the metering chamber 32 contains a dose of product and is hermetically closed by the second sealing lip 16, the flange 21 of the annular valve 4 and the end 17 of the tubular end-piece 12 of the plunger 3, which is supported against the median part of the closing membrane 20 of the annular valve 4.

From this non-operating position, if the user applies a pressure F to the support face 5 of the push button 2, as illustrated in the right-hand part of FIG. 1, this push button slides down inside the pump body 1 and the bottom end 8 of the median rod 6 elastically deforms the closing membrane 20 of the annular valve 4.

From the initial position in which the free end 17 of the tubular end-piece 12 of the plunger 3 is held in abutment with the closing membrane 20 of the valve 4 in order to isolate the metering chamber 32 from the exterior, this displacement takes place in two stages: during a first stage, the push button 2 slides along the plunger 3, and does so until the bottom end 80 of the tubular wall 10 moves into abutment against the surface acting as a stop 14, and the effect of the median rod 6 as it is lowered pushes the closing membrane 20 of the annular valve 4, but the plunger 3 is still not moving so that this closing membrane 20 moves away from the free end 17 of the tubular end-piece 12 to create a dispensing orifice 42.

During the second stage, i.e. when the end of the tubular wall 10 of the push button 2 is in abutment with the surface acting as a stop 14, the dispensing orifice 42 is uncovered and the product contained in the metering chamber 32 can be evacuated towards the ejection orifice 11, as schematically indicated by the arrows shown in broken lines, passing firstly between the tubular end-piece 12 of the plunger 3 and the median rod 6 of a the push button 2, penetrating the longitudinal grooves 7 of the is rod 6 and then into the annular ejection passage 9.

This integral sliding action of the push button 2 and the plunger 3 inside the pump body 1 continues until a peripheral flange 40 of the push button 2 sits in abutment against an opposing peripheral flange 41 of the pump body 1.

In this position, which corresponds to the actual dispensing position as such, illustrated in the right hand part of FIG. 1, the closing wall 33 of the plunger 3 is in abutment with the closing membrane 20 of the annular valve 4 and the metering chamber 32 is therefore completely emptied.

As the metering chamber 32 is being emptied, its seal is reliably maintained on the one hand by the second sealing lip 16 of the plunger 3 and on the other by the flange 21 of the annular valve 4, which is constantly supported against the side wall 100 of the pump body 1.

From this dispensing position illustrated in the right-hand part of FIG. 1, the push button 2 is automatically returned to the non-operating position illustrated in the left-hand part of FIG. 1, due to the elasticity of the closing membrane 20 of the annular valve 4.

During the course of this displacement, the dispensing orifice 42 located between the tubular end-piece 12 of the plunger 3 and the closing membrane 20 is closed and the closing wall 33 of the plunger 3 moves away from the closing membrane 20 creating a vacuum pressure.

This vacuum pressure then causes the flange 21 to lift off the shoulder 30 of the side wall 100 of the pump body 1, sucking the product contained in the receptacle R towards the metering chamber 32 through the radial slots forming the quoins 28 of the annular sleeve 24 and through the slots 31 and 34, as schematically indicated by arrows b shown by broken lines.

The metering chamber 32 is therefore automatically filled and the user can again apply a traction force F to the support face 5 of the push button 2 to empty this chamber 32 and release a dose of product, and so on.

As illustrated in FIG. 1, as the push button 2, plunger 3 and annular valve 4 are displaced from the dispensing position towards the non-operating position, outside air is drawn into the interior of the receptacle R as schematically indicated by arrows c shown in broken lines.

The invention claimed is:

1. Metering pump designed to be mounted on various receptacles, in particular receptacles containing liquid to creamy cosmetic or pharmaceutical products, and comprising a pump body (1) made from a rigid or semi-rigid material which can be adapted to fit the receptacle R, bounded in its internal part by an annular side wall (100) and by a front-end face (101) incorporating a filling orifice (25) which communicates with the interior of the receptacle, and enclosing a metering chamber (32) as well as elastically deformable control means which can be operated from the outside so as to be displaced in succession between a dispensing position and a non-operating position to enable a dose of product to be ejected from the metering chamber (32) towards the exterior through an ejection orifice (11) and then transfer a new dose of product from the receptacle towards the metering chamber (32) and so on, the control means being automatically returned from the dispensing position to the non-operating position when not subjected to any external constraint with a view to creating a vacuum pressure to enable a dose of product to be sucked towards the metering chamber (32), said metering pump being characterised in that the control means are provided in the form of a push button (2) of a rigid or semi-rigid material, a plunger (3) made from a flexible thermoplastic material designed to slide relative to the push button (2) and relative to the pump body (1) whilst remaining in permanent contact with these two elements, as well as an annular valve (4) made from an elastically deformable material in the form of a cylindrical ring (18), one of the front-end faces of which is closed by an essentially circular, stretchable closing membrane (20) which is permanently supported against the push button (2), this membrane (20) projecting onto the periphery of the cylindrical ring (18) to define a flange (21) which moves into abutment with the side wall (100) of the pump body (1) so as to close off the filling orifice (25), the control means being displaced between the non-operating position and the dispensing position in two stages, namely a first stage on the one hand, during which the push button (2) slides inside the pump body relative to the plunger (3) and the metering chamber (32) is isolated from the ejection orifice (11), and a second stage on the other hand, during which the push button (2) and the plunger (3) slide as a unit inside the pump body (1) and a dispensing orifice (42) permitting communication with the metering chamber (32), thereby uncovering the ejection orifice (11).

2. Metering pump as claimed in claim 1, characterised in that the push button (2) has a support face (5) and a median rod (6) which is constantly supported against the annular valve (4) and is surrounded by an annular ejection passage (9), which is bounded by a tubular wall (10) and communicates with the ejection orifice (11).

3. Metering pump as claimed in claim 2, characterised in that the plunger (3) has a tubular end-piece (12) mounted around the median rod (6) of the push button (2) on a level with the free end (8) thereof, and its external periphery is extended by a peripheral fin (13) so as to define a surface which acts as a stop (14) for the free end (80) of the tubular wall (10) of the push button (2), this plunger (3) being in permanent contact with the push button (2) by means of a first sealing lip (15) constantly supported against the external face of the annular ejection passage (9) on the one hand, and with the pump body (1) by means of a second sealing lip (16) constantly supported against the annular side wall (100) thereof, on the other.

4. Metering pump as claimed in claim 3, characterised in that the annular valve (4) is disposed between the front-end face (101) of the pump body (1) and the free end (8) of the median rod (6) of the push button (2), against which it is constantly supported by the median part of the closing membrane (20) and co-operates with the side wall (100) of the pump body (1) and with a closing wall (33) of the plunger (3), which is contiguous with the second sealing lip (16) to define the metering chamber (32), the tubular end-piece (12) of the plunger (3) moving into abutment with the closing membrane (20) of the annular valve (4) in the non-operating position and during the first stage of the displacement between the non-operating position and the dispensing position so that it closes off the metering chamber (32), and moving back during the second stage of this displacement so as to uncover the dispensing orifice (42) and allow the product contained in the metering chamber (32) to pass between this end-piece (12) and the median rod (6) of the push button (2) so that it can be evacuated via the ejection passage (9) and through the ejection orifice (11).

5. Metering pump as claimed in claim 2, characterised in that the median rod (6) of the push button (2) is provided with at least one longitudinal groove (7) on a level with its free end (8) and is preferably provided with a series of longitudinal grooves (7) uniformly distributed around its periphery.

6. Metering pump as claimed in claim 1, characterised in that the front-end face (101) of the pump body (1) has receiving elements (23) for the annular valve (4).

7. Metering pump as claimed in claim 6, characterised in that the receiving elements (23) of the annular valve (4) are provided in the form of a tubular sleeve (24) surrounding the filling orifice (25) and having an outer face (26) of cylindrical shape on the one hand and a conical inner face (27) inclined towards the filling orifice (25) which is also provided with radial slots (28) in the form quoins, the inner conical face (27) acting as a seat for the closing membrane (20), whilst the outer cylindrical face (26) co-operates with the pump body (1) to define a mounting seat (29) for the cylindrical ring (18) of the annular valve (4).

8. Metering pump as claimed in claim 7, characterised in that the side wall (100) of the pump body (1) is provided with an obliquely inclined shoulder (30), which forms a seat for the flange (21) of the annular valve (4) and extends alongside the mounting seat (29) incorporating a series of slots (31, 34) defining passages to the metering chamber (32) for the product contained in the receptacle.

* * * * *